US006292960B1

(12) United States Patent
Bowling

(10) Patent No.: US 6,292,960 B1
(45) Date of Patent: Sep. 25, 2001

(54) HIDDEN SAFE ASSOCIATED WITH A BED

(76) Inventor: Larry D. Bowling, 5308 Salem Church Rd., Knoxville, TN (US) 37938

( * ) Notice: Subject to any disclaimer, the term of this patent is extended or adjusted under 35 U.S.C. 154(b) by 0 days.

(21) Appl. No.: 09/531,788

(22) Filed: Mar. 21, 2000

(51) Int. Cl.[7] ..... A47C 21/00
(52) U.S. Cl. ..... 5/308; 5/931; 5/503
(58) Field of Search ..... 5/2.1, 58, 308, 5/931, 503

(56) References Cited

U.S. PATENT DOCUMENTS

| | | | | |
|---|---|---|---|---|
| 3,082,435 | | 3/1963 | Philips et al. . | |
| 4,490,864 | * | 1/1985 | Wicker | 5/308 |
| 4,597,122 | * | 7/1986 | Handler et al. | 5/503 |
| 4,807,315 | | 2/1989 | Wachenheim . | |
| 5,070,556 | * | 12/1991 | Gloger | 5/308 |
| 5,095,566 | | 3/1992 | Russell . | |
| 5,687,435 | | 11/1997 | Dufresne . | |
| 5,713,650 | | 2/1998 | King et al. . | |
| 5,983,420 | | 11/1999 | Tilley . | |

* cited by examiner

*Primary Examiner*—Lynne H. Browne
*Assistant Examiner*—Fredrick Conley
(74) *Attorney, Agent, or Firm*—Pitts & Brittian, P.C.

(57) ABSTRACT

An improved concealed safe is disclosed for concealment of firearms and other valuables therein, the safe being sized and shaped to replace a bed box-springs. The safe includes a top surface to support a mattress of a bed, a bottom surface to engage a supporting floor, a plurality of exterior side walls and corners being sized and shaped to support a mattress bed. The safe includes an internal storage cavity bounded by interior walls a lower floor. The safe includes side wall openings through at least one of the exterior side walls and through respective interior walls, into which one or more drawers can be inserted into the storage cavity. Each drawer is lockable and concealed from view when inserted into the safe in a concealed position, and each drawer is extendable outwards from the storage cavity into an exposed position. A rolling means supports each drawer and allows each drawer to be moved along at least one pair of roller tracks positioned on an interior wall within the storage cavity, providing a user ease of opening and loading each drawer in the exposed position, and allowing closing each drawer to the concealed position into the concealed safe that is hidden under a mattress and appears as a bed box-springs.

15 Claims, 7 Drawing Sheets

HIDDEN SAFE ASSOCIATED WITH A BED

BACKGROUND OF INVENTION

1. Field of Invention

This invention relates to the field of concealed safes. More specifically this invention relates to a concealed safe hidden under a bed, with the safe having lockable drawers for storage of firearms and other valuables.

2. Description of Related Art

Prior support frames for beds have provided internal compartments within the support frames for storage of items. Typical bed support frames are disclosed in U.S. Pat. No. 5,687,435, issued to Dufresne, which discloses a space saver platform, hiding bed assembly having rigid covers that open upwards to reveal multiple storage compartments. A bed mattress can be placed on the rigid covers but must be removed before the rigid covers can be opened upwards.

U.S. Pat. No. 5,095,566, issued to Russell, discloses a storage locker that can support a bed, the storage locker having side wall doors that pivot upwards for entry into the storage locker. The side wall doors of the storage locker can be opened a distance upwards that is limited by the amount of overhang of a bed mattress placed on top of the storage locker.

U.S. Pat. No. 3,082,435, issued to Philips et al., discloses an article of furniture that includes a top surface that can support couch cushions, bed mattresses, and/or additional furniture, and includes side wall drawers of generally light weight that open laterally outwards for storage of items within the drawers within the furniture.

Additional prior devices that relate to beds and safes are discussed in the following U.S. Patents that define beds and/or bed frames having internal, lockable containers. U.S. Pat. No. 5,713,650, issued to King, et al., discloses a furniture unit including a frame having at least one secure container within the frame. A door of the secure container is lockable in a closed position in the frame by a padlock positioned on the door. The secure container fits into a frame side that opposes a second frame side having drawers therein. The secure container includes means extending from the secure container into the frame to secure the container in a fixed position within the frame. The means extending includes a nut welded to the frame, and a bolt securing arrangement that is fixed to and within the frame. The secure container includes a quick access door separate from the lockable door, with the quick access door independently lockable within the container.

U.S. Pat. No. 4,807,315, issued to Wachenheim, discloses a waterbed pedestal for supporting a waterbed frame and mattress. The pedestal includes a plurality of panels defining a cavity in the pedestal, with a safe positioned within the cavity. The safe is secured within the cavity with an attaching means, such as fixed flanges, to position the safe in the cavity behind a removable panel that hides the cavity and the safe. An anti-theft means secures the safe in position by attaching the safe to one of the sides of the cavity. The removable panel includes a door hinged and mounted to the pedestal panel to hide the safe. The safe is not removable from a fixed position within the cavity unless the attaching means, hidden behind the safe, is disconnected.

The prior support frames are generally frames having an internal cavity into which drawers are positioned, with a lockable safe or secure container positioned permanently within the support frame. Therefore, a user must open one or more panels or doors, and reach into the safe or container to retrieve one or more generally small and/or light-weight items of value stored within the safe. There is a need for an improved, hidden safe containing sliding drawers that provide ease of access to articles of value having extended length, width, and/or heavy weight. There is also a need for a concealed safe that is positionable in an inconspicuous position in a home and that is quickly accessible to an owner.

Therefore, it is an object of the present invention to provide an improved safe that replaces a bed box-springs to support a mattress of a bed.

It is another object of the present invention to provide a concealed safe of sufficient size and shape to be generally unmovable by an intruder, and to provide a reinforced interior cavity accessible to a user for lockable storage of articles of value.

It is another object of the present invention to provide a concealed safe that is sized and shaped to support a mattress of a bed, the safe having at least one lockable drawer slidably extendable from the interior of the safe, into which firearms and other sizable articles of value can be placed for safekeeping and concealment.

It is another object of the present invention to provide a plurality of independently lockable storage compartments within a disguised safe supporting a mattress of a bed, with the storage compartments having drawers that are slidably movable into the safe for disguised storage of weapons and other articles of value.

BRIEF SUMMARY OF THE INVENTION

Other objects and advantages will be accomplished by the present invention which includes an improved concealed safe being sized and shaped to replace a box-springs for a bed, the concealed safe including exterior walls having a top surface to support a mattress for a bed, a bottom surface to engage a supporting floor, a plurality of exterior side walls being connected between the top surface and the bottom surface, and exterior corners being sized and shaped to support the mattress. The concealed safe provides for secure storage of portable firearms and other articles of value having extended length and/or width. The concealed safe includes a plurality of interior walls being generally oriented parallel to each respective wall of the exterior walls, the interior walls having internal surfaces, the plurality of interior walls including a lower surface parallel to and interior of the bottom surface of the exterior walls of the safe. A storage cavity is formed within the safe and is bounded by the internal surfaces of the plurality of interior walls. An opening is provided through one of the plurality of exterior side walls of the concealed safe, the opening being extended through the respective interior wall into the storage cavity. A drawer is provided and is movable through the opening, the drawer being positionable in a concealed position by being inserted into the storage cavity, the drawer also being positionable in an exposed position by being extended outwards from the storage cavity through the opening, the drawer including an outwardly faced surface having at least one rolling means attached thereon. The drawer includes an end cover being oriented to cover the opening when the drawer is in the concealed position. The end cover includes a lock thereon, the drawer being lockable with the lock when in the concealed position. The interior walls of the storage cavity and/or portions of the outwardly faced surface of the drawer include at least one roller track on at least one of the interior walls, preferably on the lower floor of the storage cavity. The at least one roller track being aligned with the at least one rolling means attached on the drawer. The user of the concealed safe can position a mattress bed on top of the concealed safe, which replaces the box-springs, and can place the articles of value having extended length and/or width such as guns and/or rifles into the drawer when the drawer is positioned in the exposed position. The user can position the drawer to the concealed position by the rolling means being rolled along the at least one roller track until the drawer is concealed within the storage cavity. The drawer is lockable in the concealed position with the lock. A plurality of drawers having locks can be provided in the exterior side walls to provide space-efficient, secure storage in the concealed safe for firearms and other articles of value, with the concealed safe disguised as a replacement box-springs positioned underneath a mattress for a bed.

BRIEF DESCRIPTION OF SEVERAL VIEWS OF THE DRAWINGS

The above mentioned features of the invention will become more clearly understood from the following detailed description of the invention read together with the drawings in which.

DETAILED DESCRIPTION OF THE INVENTION

Figure 1:
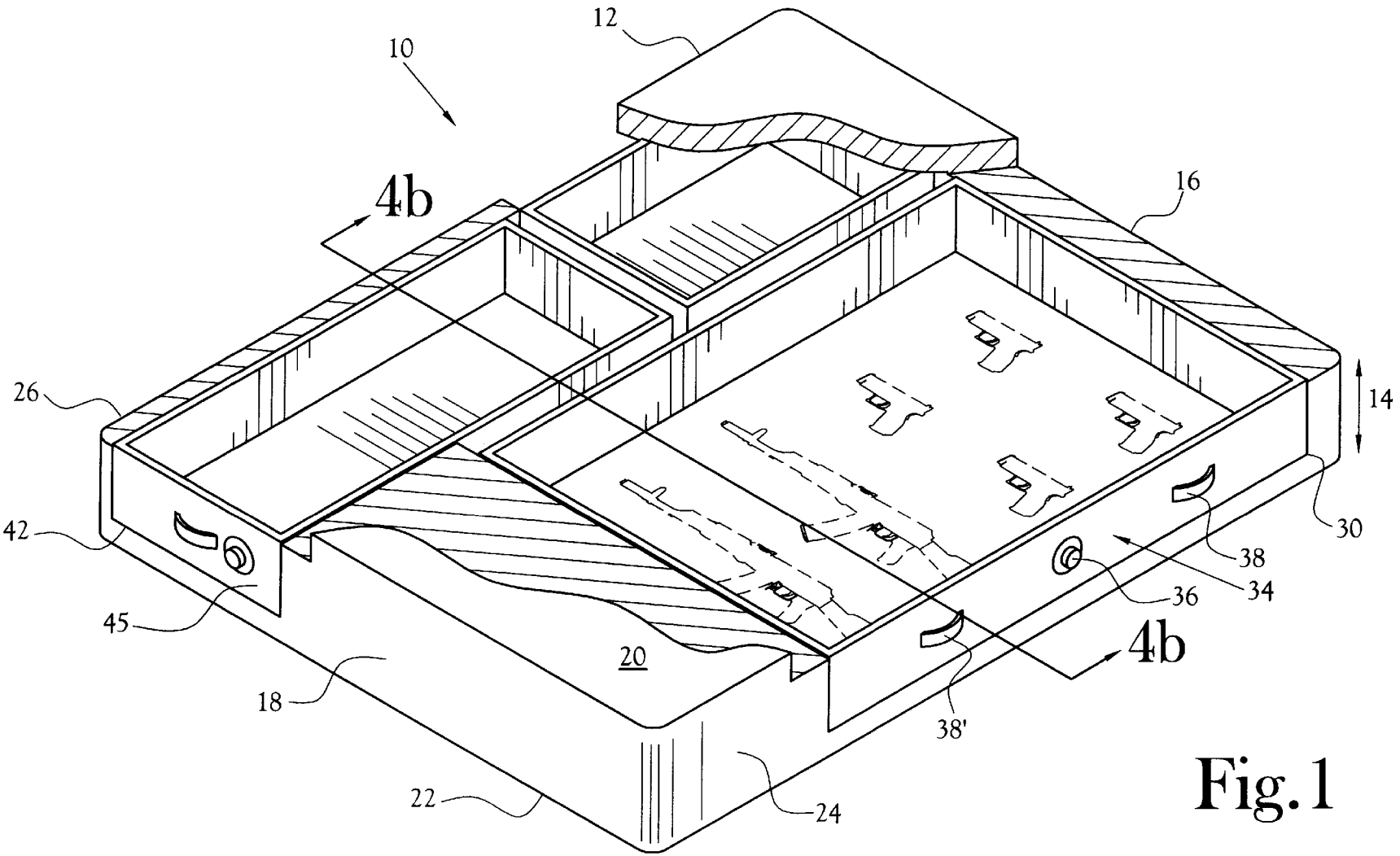
FIG. 1 is a perspective view of one embodiment of the improved concealed safe constructed in accordance with several features of the present invention sized and shaped generally similar to a bed mattress and having a plurality of interior storage compartments.

An improved concealed safe is disclosed incorporating various features of the present invention as illustrated generally at 10 in FIG. 1. The improved concealed safe 10, is designed in a configuration having generally the size and shape of a mattress 12 (see FIG. 2) having twin-size, queen-size, or king-size proportions. The concealed safe 10 is configured in a height 14 of generally the height of a bed box-springs that the concealed safe 10 is designed to replace and mimic in size and shape a mattress 12.

The preferred embodiment, as illustrated in FIGS. 1–4*b*, is designed to support a mattress for a bed, by placement of the concealed safe 10 underneath the mattress and directly on the supporting surface of the floor, or by placement within a bed support frame (not shown) that is built to support the heavy weight of the concealed safe 10. The preferred embodiment of concealed safe 10 does not include support springs within the upper portion of the height 14 of the safe as an alternative embodiment may include, but a cushioned pad (not shown) can be provided to cover the top surface 20, and/or the plurality of exterior side walls. As shown in FIG. 1, a head board first end 16 comprises the first end of the plurality of exterior walls of the concealed safe 10, with the opposing end being the foot board second end 18. If preferred by an user to bolster the disguise of the concealed safe 10 as a box-springs, a bed head board (not shown), and a bed foot board can be attachable by brackets (not shown) to the respective first end 16 and/or second end 18.

Figure 2:
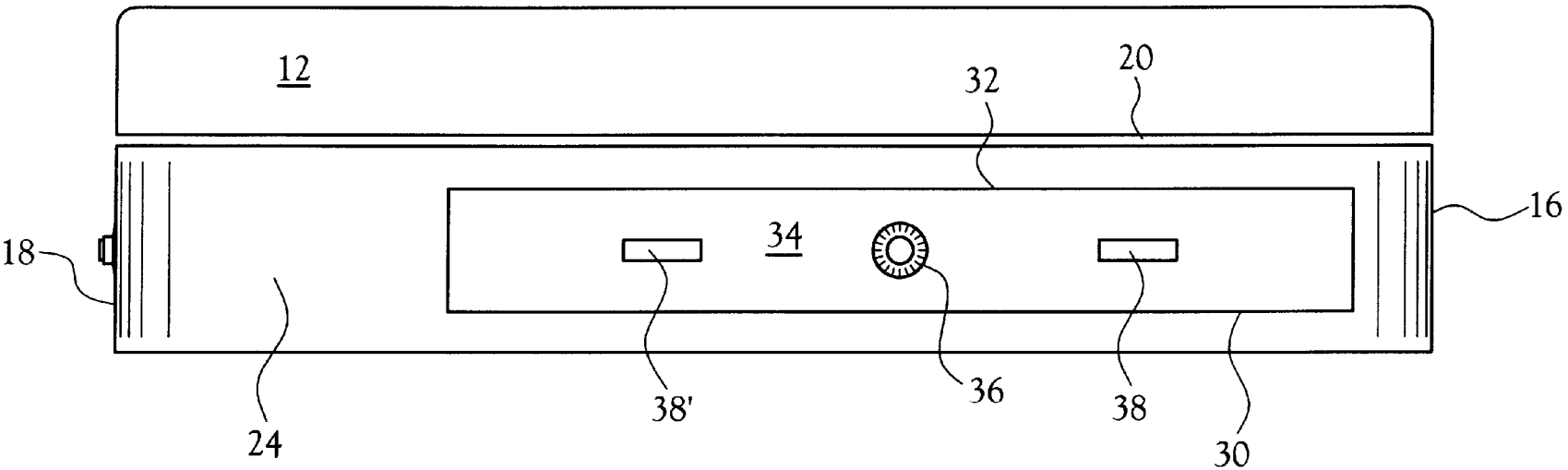
FIG. 2 illustrates a side perspective view of FIG. 1, illustrating the drawer positioned in a concealed position within the storage cavity of the concealed safe.

In FIGS. 1–3*a*, one exterior side wall, namely the first side wall 24 that is opposite a second side wall 26, can include an opening 28 through which a movable first elongated drawer 30 is positioned. FIG. 2 illustrates the first drawer 30 in a concealed position within the first side wall 24.

The preferred embodiment provides the drawer 30 having an interior drawer floor 32 (see FIG. 4*b*), and an end cover 34 that covers the opening 28 when the drawer 30 is positioned in a concealed position as shown in FIG. 2. The end cover 34 can include a locking mechanism 36 such as a rotary lock, or alternatively a key operated lock (not shown), along with one or more handles 38, 38' for opening and closing the drawer 30.

As illustrated in FIG. 1, one embodiment includes a second drawer 42 that is positioned in the foot end 18 of the concealed safe 10. The second drawer 42 can be a relatively narrow width in relation to the elongated first drawer 30, to allow both drawers to be positioned in concealed positions in the safe 10 and underneath the mattress 12 without internal contact of each drawer within the concealed safe 10. The second drawer 42 includes an interior floor 44 onto which articles of value can be positioned and/or attached, includes an end cover 45, and includes a second drawer lock 46 and at least one drawer handle 48.

Figure 4A:
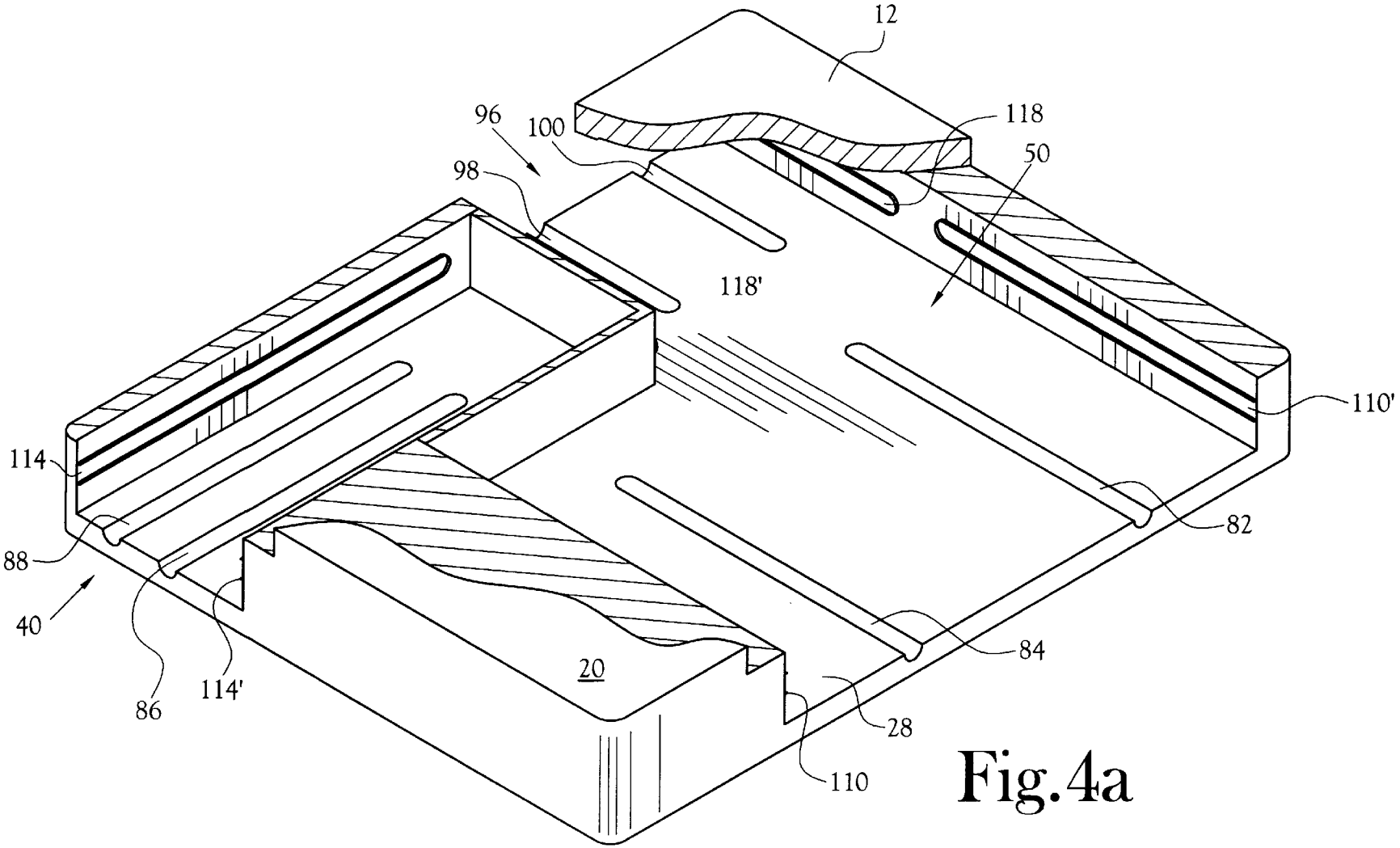
FIG. 4*a* illustrates a perspective view of FIG. 1 with the internal drawers removed, illustrating a plurality of roller tracks within the storage compartments.

As illustrated in FIGS. 1 and 4*a*, the concealed safe 10 includes exterior walls having the top surface 20, a bottom surface 22 facing the supporting floor, the first side wall 24, second side wall 26, first end 16, and second end 18. Each drawer, if more than one drawer is utilized, is positionable in the concealed position within a storage cavity 50 within the safe 10. The storage cavity 50 is bounded by a plurality of interior walls of the safe 10, thereby providing a double-walled configuration that provides increased structural strength to the safe 10, and provides increased security for articles of value stored within or on the floor 32 of first drawer 30, and/or floor 44 of second drawer 42.

As illustrated in FIG. 4*a*, the plurality of interior walls of the storage cavity 50 include interior head side wall 52 that is oriented parallel to head board end 16, and second side wall 54 that is oriented generally parallel to second outer side wall 26. A foot side wall 56 is oriented generally parallel to foot board end 18, except for a corner section 56' that connects with second opening 40, with corner section 56' being generally oriented parallel to second side wall 26. The interior surface 58 of the drawer end cover 34 serves as the interior first side wall, and is generally parallel to the outer first side wall 24. In an alternative embodiment, first drawer 30 can be oriented to be insertable through an opening (not shown) in second side wall 26, with first side wall 24 being a solid surface with a solid interior side wall (not shown). The exterior of the concealed safe 10 and interior walls 52, 54, 56, 56', 58 can be constructed of steel or other high-strength metal or composite material that deters forcible entry by breakage of one or more of the exterior walls. The interior side walls 52, 54, 56, 56' that are stationary are connected to an interior floor 60 of the interior of the cavity. The interior floor 60 is oriented generally parallel to the bottom exterior surface 22 of the safe 10.

Figure 3A:
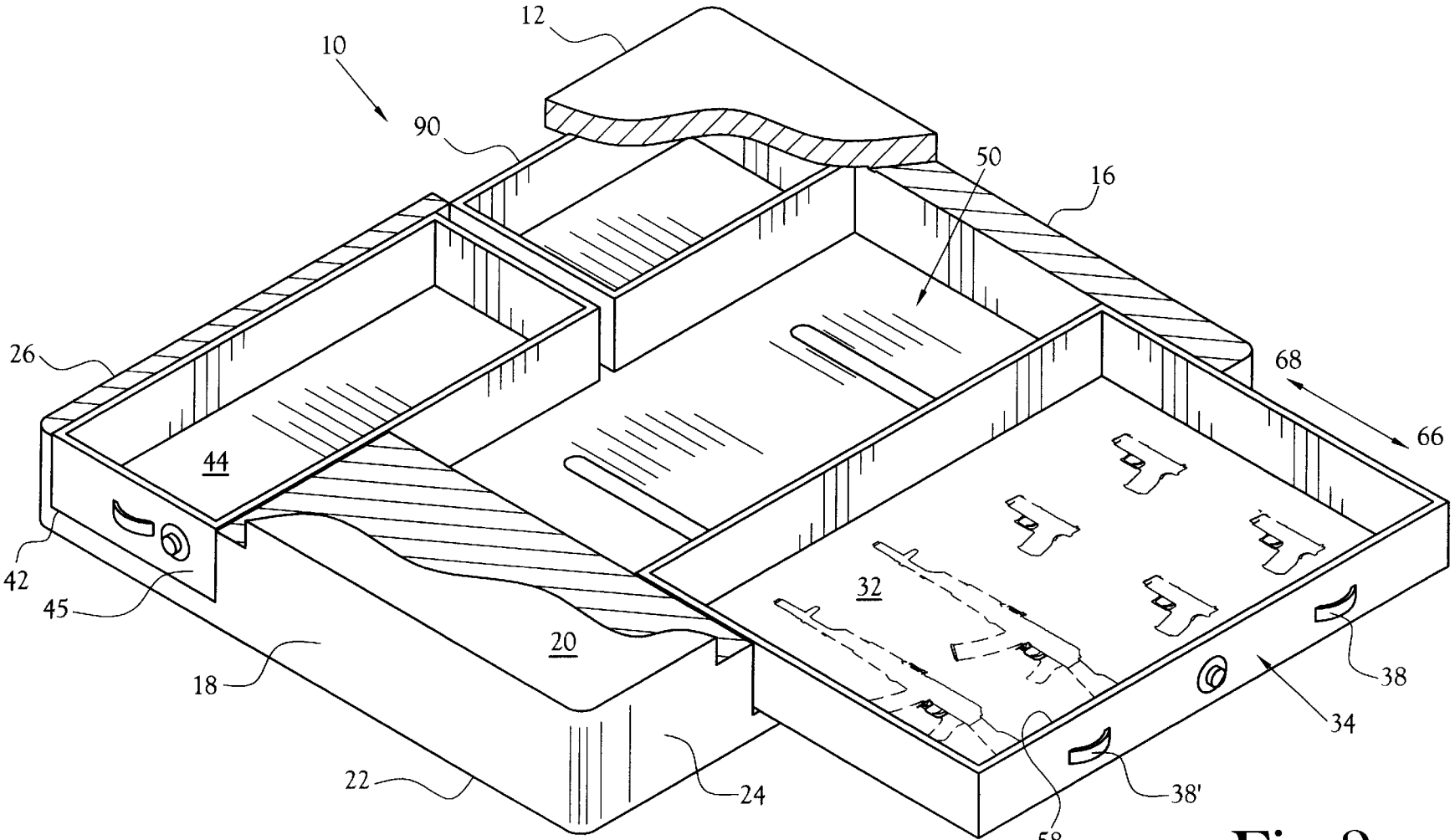
FIG. 3*a* is a partial perspective view of the drawer positioned in an exposed position extending outwards from the storage cavity of the concealed safe.
Figure 3B:
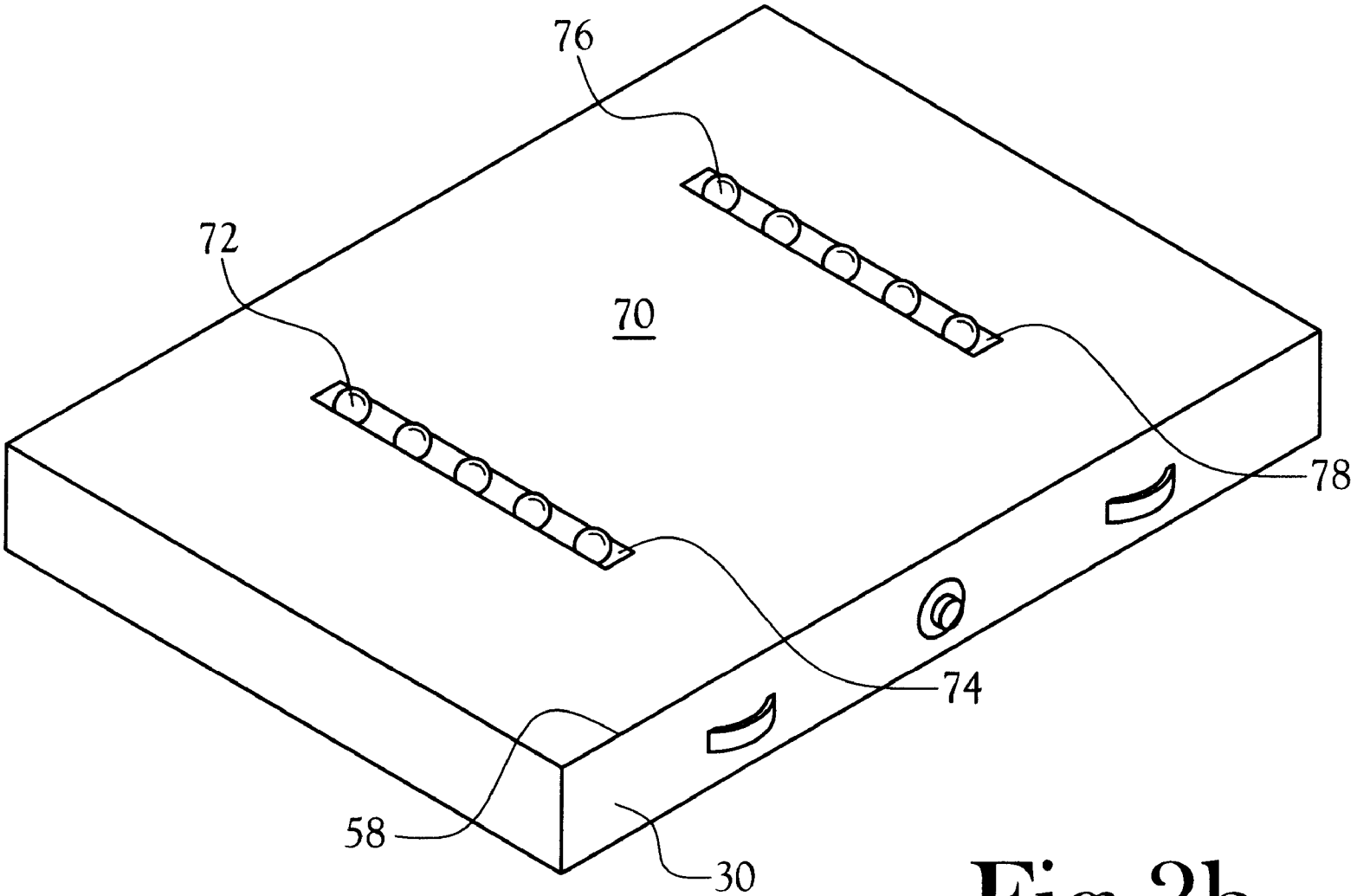
FIG. 3*b* is a perspective view of an outwardly faced surface of one drawer having a rolling means attached to the underside surface.
Figure 4B:
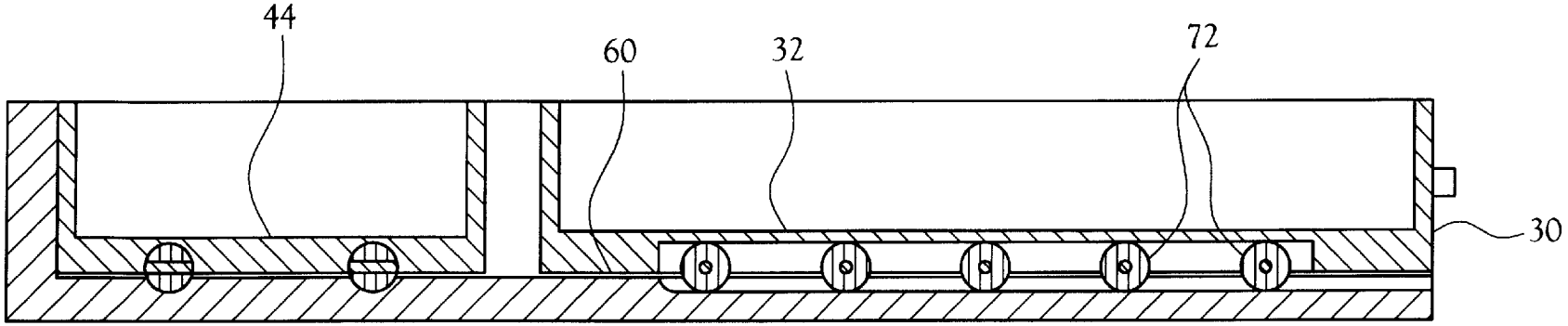
FIG. 4*b* illustrates a side view, in section taken at 4*b*—4*b* of FIG. 1.
Figure 4C:
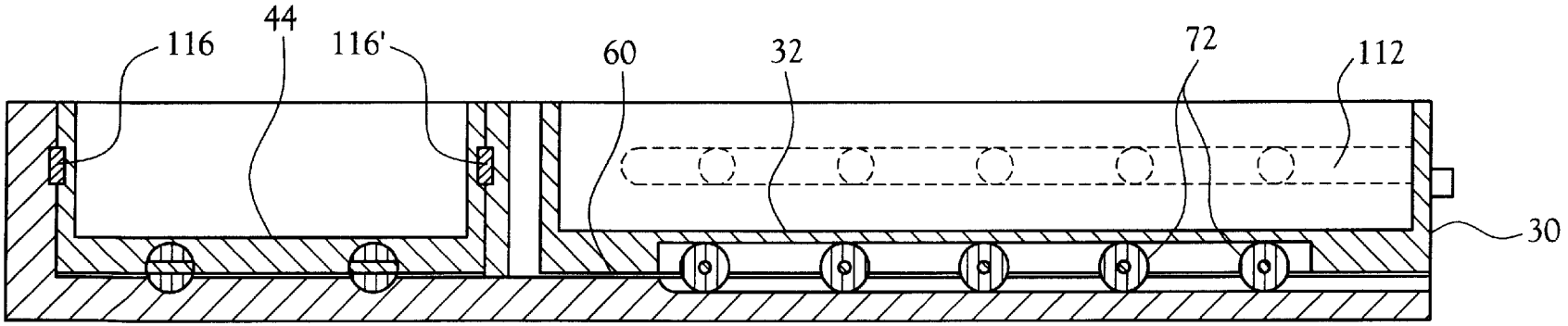
FIG. 4*c* illustrates a side view of an alternate embodiment of FIG. 4*b*.

As illustrated in FIGS. 3*a*, 3*b*, and 4*b*, a first drawer 30 is positionable outwards 66 in an exposed position (see FIG. 3*a*), or positionable inwards 68 in a concealed position (see FIGS. 3*a* and 4*b*), by being insertable through opening 28 and into the storage cavity within concealed safe 10. The means of movement of the drawer 30 is by a rolling means attachable to at least one outwardly faced surface of the drawer, either the two sides of the drawer, or preferably the underneath surface 70 of the drawer 30. The rolling means includes a first rolling unit having at least a first set of a plurality of rollers 72 having about two to five, or more, generally cylindrical or spherical rollers. The rolling means also includes a channel unit being oppositely disposed within the storage cavity for movable support of the drawer, the channel unit positioned adjacent the first rolling unit to allow the drawer to be movably positioned in the concealed position or in the exposed position.

The rolling unit includes a first set of rollers 72, having two to five, or more, generally cylindrical or spherical rollers, with each suspended on separate rotational axes between a parallel pair of brackets or tracks 74 for the first set of rollers. A second set of a plurality of rollers 76 includes about two to five, or more, generally cylindrical or spherical rollers, with each roller aligned and suspended on separate rotational axes between a parallel pair of brackets or tracks 74 for the first set of rollers. The first set of rollers 72, and second set of rollers 76, and associated brackets or tracks 74, 78, are aligned parallel to each other, and oriented in the direction of movement 66, 68 of drawer 30, and attachable to the under surface 70 of first drawer 30. Alternative configurations of rollers are known to persons skilled in the art and can be utilized to allow the drawer 30 to be positionable along the direction of movement 66, 68. Similar configurations of sets of rollers are attached to the underside surface of the floor 44 of second drawer 42, and each additional drawers that are to be insertable into additional openings in side walls of concealed safe 10.

When the drawer 30 is positioned into the storage cavity 50 in the concealed position, each of the sets of rollers 72, 76 follow along and into channel units that include a pair of rolling tracks 82, 84. In one embodiment, each roller track 82, 84 is oriented inside the storage cavity 50 along an upper faced portion of the lower interior floor 60 (see FIG. 4*a*). Each roller track 82, 84 is positionable parallel to the other pair of roller tracks for alignment with the at least one rolling means attached to the underside of the drawer 30. In one embodiment, the at least two pair of roller tracks 82, 84 is indented a sufficient depth into the upper faced portion of the lower interior floor 60 so that the indented roller tracts form channels for the at least one rolling means to follow along in when the drawer 30 is positioned in the concealed position, and when drawer 30 is moved to the exposed position. A sufficient depth into the upper faced portion of the floor 60 can range from about one eighth (⅛) inch, to about one half (½) inch, with each roller track 82, 84 having a width of about one quarter (¼) inch to about one inch wide. Utilizing two generally parallel and adequately indented roller tracks allows a heavy drawer 30 containing a plurality of heavy articles of value to move smoothly into the storage cavity to the concealed position (see FIG. 4*b*). Similar parallel spaced roller tracks 86, 88 are oriented inside the second opening 40, extending into the storage cavity 50, to allow the potentially heavily weighted second drawer 42 to be positioned in the concealed position.

An alternate embodiment for the rolling means includes at least one set of side rollers movable between pairs of rails attachable to each side of drawer 30. The side oriented rollers are insertable into, and mate with a set of parallel side tracks (not shown) on each of the interior surfaces of interior wall 52 and 56, with each respective side of drawer 30 movably supported between interior walls 52, 56.

A further alternative embodiment provides one centered roller track, or two parallel roller tracks in the interior ceiling (not shown) of the storage cavity for each drawer that is insertable into a respective opening. By providing roller tracks in the interior ceiling, the user is provided the option for removal of appropriate drawers and flipping over of the bulky concealed safe 10 in the shape of a mattress 12, with reinsertion of appropriate drawers in an upright orientation into one or more openings oriented on the appropriate side of the concealed safe 10. Repositioning of the concealed safe for covering by a mattress 12, and reinsertion of the drawers therein, allows for a user to position the concealed safe 10 underneath a bed mattress 12 in a variety of locations within a room to hide the drawers from the sight of a potential intruder entering the room of the user. A box springs (not shown) can be placed on the top surface 20 between the surface 20 and the mattress 12 for additional disguise of the concealed safe 10.

An alternative embodiment provides a configuration (not shown) that positions at least two indented roller tracks on the underneath surface 70 of the drawer 30, and on the underneath surface of each additional drawer insertable into the concealed safe 10. At least one set of a plurality of in-line rollers, with each set supported between a pair of rails, can be attachable to the interior floor 60 underneath each drawer within the interior of the cavity to provide a rolling means for each respective drawer.

As recognized by those skilled in the art, an alternative roller means can include a pair of heavy equipment drawer slides 112, 112' positioned on side walls of first drawer 30, comparably positioned drawer slides 116, 116' on the second drawer 42 (see FIGS. 4*a*–4*c*), and additional slides for additional drawers (not shown). Associated track and/or channel units can be positioned on interior walls within storage cavity 50, at locations 110, 110' for support of first drawer 50, at locations 114, 114' for support of second drawer 42, and at locations 118, 118' for support of a third drawer 90 (if utilized). The heavy equipment drawer slides and tracks provide support for the side walls of each drawer to minimize dipping in a downwardly direction when each drawer is in exposed position 66. The drawer slides can include rolling metal wheels and rows of steel ball bearings fitting into rails of precise dimensions for support of heavy loads as may be placed into each respective drawer of the concealed safe 10.

Figure 5:
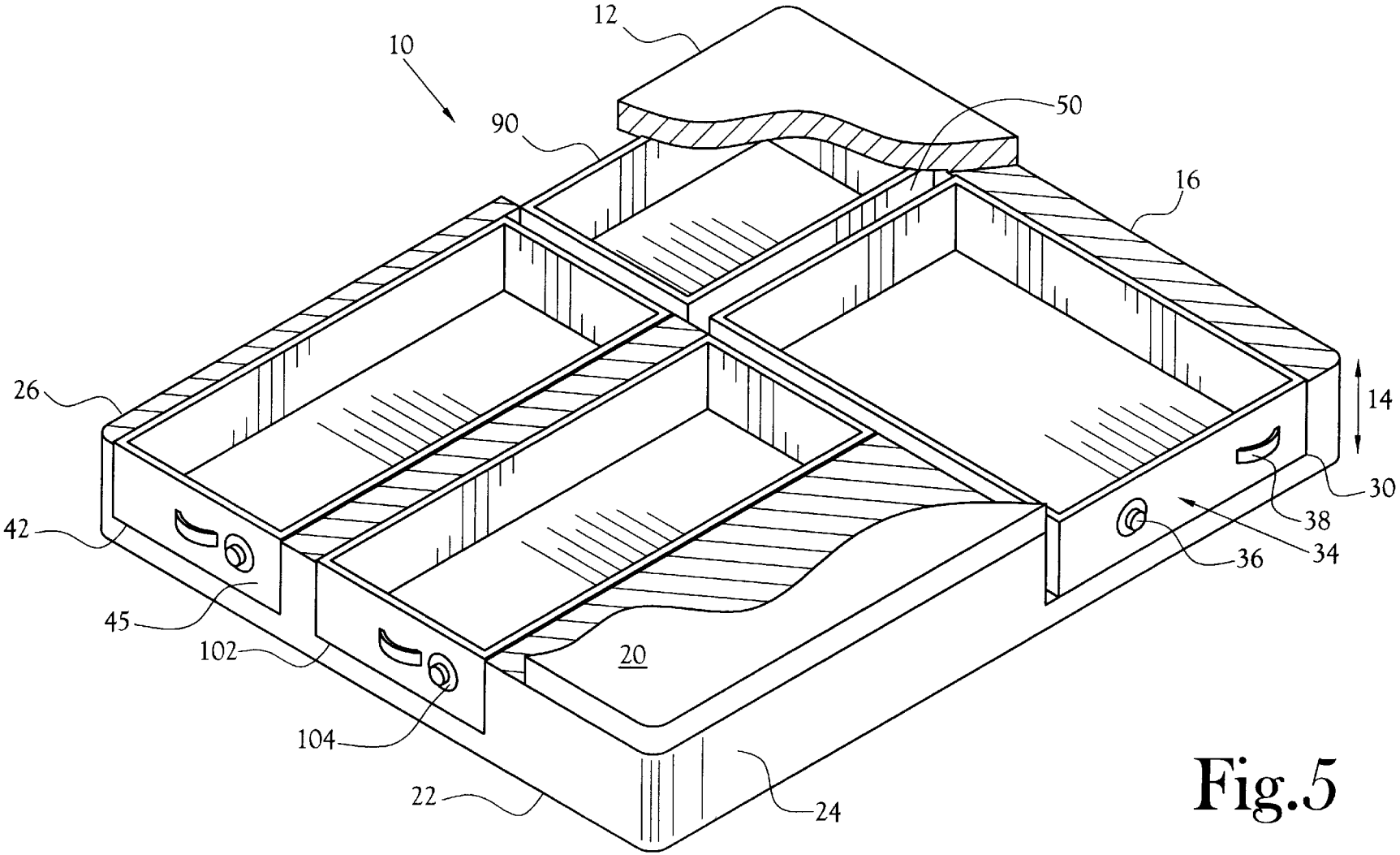
FIG. 5 illustrates a perspective view of an alternative embodiment of the improved concealed safe having a plurality of interior storage compartments.

An additional alternative embodiment can include a third drawer 90 and lock (not shown) in the position as illustrated in FIGS. 3*a* and 5, if the depth of the first drawer 30 is reduced. A further alternative embodiment can include a fourth drawer 102 and lock 104 in the position as illustrated in FIG. 5. Additional combinations of lockable drawers, either side-by-side, or stacked one above another will be recognizable to those skilled in the art.

In an alternate embodiment, the drawer 90 similar to first elongated drawer 30, but having a limited depth into storage cavity 50, can also be positioned in the second side wall 26 (see FIG. 5), without obstructing either first drawer 30 in first side wall 24, or second drawer 42 in second end 18.

From the foregoing description, it will be recognized by those skilled in the art that an improved hidden safe offering advantages over the prior art has been provided. Specifically, the concealed safe provides a space-efficient, secure storage for articles of value such as rifles and/or pistols, with the concealed safe disguised as a replacement bed box-springs positionable underneath a bed mattress. The side-mounted drawer provides for convenient and rapid access to a weapon for an owner on the bed mattress supported by the concealed safe, while also providing a lockable storage unit that is out-of-sight of other family members, such as young children. The disguised nature of the concealed safe can be improved by covering the concealed safe with a mattress pad, box springs cover, or a bed skirt that overhangs the locks and drawers, while still providing easy access by an owner having the combination to the locks. The concealed safe can include attaching members on a header end opposite the end having one or more drawers therein, to allow a headboard to be attachable to the header end to increase the disguise of the concealed safe. A further benefit of the disguised safe is that the large dimensions, either twin-size, queen-size, or king-size, and the bulky weight of the disguised safe decreases the possibility of one or two intruders removing the safe if the intruders fail to breach the lockable drawers.

While a preferred embodiment has been shown and described, it will be understood that it is not intended to limit the disclosure, but rather it is intended to cover all modifications and alternate methods falling within the spirit and the scope of the invention as defined in the appended claims.

What is claimed is:

1. A concealed safe being sized and shaped to replace a bed box-springs, the concealed safe including exterior walls having a top wall outer surface to support a mattress bed, a bottom wall outer surface to engage a supporting floor, a plurality of exterior side walls being connected between the top surface and the bottom surface, and exterior corners being sized and shaped to support the mattress bed, the concealed safe provides a secure storage of articles of value having extended length and/or width, the concealed safe comprising:

a plurality of interior walls, each of said interior walls being oriented parallel to the respective wall of the exterior walls, each of said interior walls having internal surfaces, said plurality of interior walls including a lower floor parallel to and interior of said bottom surface of the exterior walls;

a storage cavity being bounded by said internal surfaces of said plurality of interior walls;

an opening through at least one of the plurality of exterior side walls of the concealed safe, said opening being extended through respective interior wall of said plurality of interior walls, said opening being extended into said storage cavity;

a drawer being movable through said opening, said drawer being positionable in a concealed position by being inserted into the storage cavity, said drawer including an outwardly faced surface being oriented toward said internal surfaces of said storage cavity when said drawer is positioned in a concealed position, said drawer being positionable in an exposed position by being extended outwards from said storage cavity through said opening, said drawer having an end being oriented to cover said opening when said drawer is positioned in said concealed position, said end having a lock thereon, said drawer being lockable with said lock; and a rolling means including a first rolling unit and a channel unit being oppositely disposed within said storage cavity for support of said drawer, said rolling means positioned to movably support said drawer for being positionable in said concealed position or in said exposed position;

whereby when the drawer is positionable in said exposed position with said rolling means, the articles of value can be placed into said drawer for secure storage of the articles of value when said drawer is movable by said rolling means to said concealed position, said drawer being lockable in said concealed position with said lock.

2. The concealed safe of claim 1, wherein said rolling means comprises:

a said first rolling unit including a plurality of rollers aligned and attachable on said outwardly faced surface of said drawer, said plurality of rollers being oppositely disposed to and aligned with said channel unit to movably support said drawer; and said channel unit including at least one rolling track being oppositely disposed to said first rolling unit within said storage cavity for movable support of said drawer;

whereby said drawer being movably supported by said plurality of rollers being moved through said at least one rolling track for said drawer being positionable in said concealed position or in said exposed position.

3. The concealed safe of claim 2, wherein said at least one rolling track comprises at least two pair of rolling tracks attachable on said lower floor of said plurality of interior walls in an upwards faced position, each of said at least two pair of rolling tracks being positioned parallel to each adjacent rolling track, each rolling track having one end of each being originated in proximity to said opening, each rolling track being aligned with said plurality of rollers on said drawer, each of said at least two pair of rolling tracks being indented into said lower floor, whereby said at least two pair of rolling tracts provide indented rolling tracks for said plurality of rollers to fit on when said drawer is positioned in said concealed position.

4. The concealed safe of claim 3, wherein said at least one rolling means comprises:

at least two pair of rollers on said outwardly faced surface of said drawer, said outwardly faced surface includes an underside surface of said drawer, said at least two pair of rollers being insertable into said at least two pair of roller tracks being indented in said upper faced portion of said lower a floor, and said at least two pair of rollers project downward from said underside surface for alignment with each respective indented roller tracts when said drawer is positionable in a concealed position within said storage cavity.

5. The concealed safe of claim 1, wherein said rolling means comprises:

said first rolling unit including a plurality of rollers aligned and attachable on said lower floor of said plurality of interior walls, said plurality of rollers being oppositely disposed to and aligned with said channel unit to movably support said drawer; and said channel unit including at least one rolling track being oppositely disposed from said first rolling unit, said channel unit being positioned on said outwardly faced surface of said drawer for movable support of said drawer;

whereby said drawer being movably supported by said plurality of rollers being moved through said at least one rolling track for said drawer being positionable in said concealed position or in said exposed position.

6. The concealed safe of claim 1, wherein said opening comprises a plurality of openings in at least two of the exterior side walls, each of said plurality of openings being extended into said storage cavity through respective interior walls of said plurality of interior walls.

7. An improved hidden safe to replace a bed box-springs underneath a mattress of a bed, the improved safe having exterior walls being oriented in the shape of a bed box-springs, the exterior walls including a top wall outer surface to support the mattress bed, a bottom wall outer surface to engage a supporting floor, a plurality of side walls being connected between the top surface and the bottom surface, and exterior corners being shaped and sized to support the mattress bed, the improved safe providing secure storage by a user of articles of value having extended length and/or width, the improvement comprising:

a plurality of interior walls, each of said interior walls being oriented parallel to each respective side wall of the exterior walls, said plurality of interior walls including a lower floor being parallel to and interior of said bottom wall outer surface of the exterior walls;

a storage cavity being bounded by said plurality of interior walls, said lower floor having an upward facing surface;

an opening through one of the exterior side walls of the improved safe, said opening being extended through the respective interior walls into said internal cavity;

a drawer being insertable into said opening, said drawer being positionable in a concealed position by being inserted into the storage cavity, said drawer being positionable in an exposed position by being extended outwards from said storage cavity through said opening, said drawer including a lower surface having at least one rolling means attached to said lower surface, said drawer having an exterior wall being oriented to cover said opening when said drawer being in said concealed position, said exterior wall having a lock thereon; and at least one roller track on at least one internal surface of said plurality of interior walls, said at least one roller track being aligned with said rolling means on said lower surface of said drawer;

whereby the articles of value having extended length and/or width being placed into said drawer when extended in said exposed position for secure storage when said drawer is in said concealed position within said storage cavity of said improved safe, said drawer being extended from said storage cavity by being rolled along said at least one roller track until said drawer is in said exposed position to allow the user ease of placement of articles of value therein.

8. The improved safe of claim 7, comprising a plurality of openings in the exterior side walls, each of said plurality of openings being extended into said storage cavity through respective interior walls of said plurality of interior walls, said drawer of the improved hidden safe further comprises a plurality of drawers, one of each of said plurality of drawers being sized to be separately positioned in one of each of said plurality of openings, whereby the improved hidden safe includes said plurality of openings with each opening having one drawer positioned therein.

9. The improved safe of claim 8, wherein said lower floor having said upward facing surface further comprises at least one pair of roller tracks being oriented on said upward facing surface, each pair of said at least one pair of roller tracks being oriented perpendicular to and being originated in proximity to each of said plurality of openings, each one of said pair of roller tracks being aligned parallel with said at least one rolling means on said drawer, said at least one pair of roller tracks being indented in said lower floor surface, said indented pair of roller tracts being channels for said at least one rolling means when said drawer is positioned in said concealed position.

10. The improved safe of claim 9, wherein said at least one rolling means comprises:

at least two pair of rollers on said lower surface of said drawer, said at least two pair of rollers being insertable into said at least two pair of roller tracks in said lower floor surface, and said at least two pair of rollers project downward from said lower surface of said drawer, each of said rollers being aligned with each respective indented roller tract when said drawer is positionable in a concealed position within said storage cavity.

11. An improved concealed safe being sized and shaped to replace a bed box-springs underneath a mattress bed, the improved safe having a frame bounded by a top surface, a bottom surface, a plurality of side walls between the top surface and bottom surface, and exterior corners being positioned to support a mattress bed, the improved safe providing secure storage by a user of articles of value, the improvement comprising:

an internal cavity being enclosed within the frame, said internal cavity being bounded by an upper wall, a lower floor, a plurality of interior side walls;

a plurality of openings through said plurality of side walls of the frame, each of said opening being extended into said internal cavity;

a plurality of drawers, each drawer being insertable into each of said plurality of openings in a concealed position, each of said plurality of drawers being extendable independently out of said internal cavity into an exposed position, each of said plurality of drawers including outwardly faced surfaces and an underside surface, each of said plurality of drawers having an exterior wall being oriented to cover said opening, said exterior wall of each drawer having a lock thereon; and a rolling means including a first rolling unit and a channel unit being oppositely disposed within said internal cavity for support of said drawer, said rolling means positioned to movably support said drawer for being positionable in said concealed position or in said exposed position;

whereby the articles of value being placed into each of said plurality of drawers when each drawer is positioned in said exposed position with said rolling means, each drawer being independently positioned in said concealed position for secure storage of the articles of value in said internal cavity of said improved hidden safe, without movement of said improved hidden safe from underneath the mattress.

12. The improved safe of claim 11, wherein said rolling means comprises:

said first rolling unit including a plurality of rollers aligned and attachable on said outwardly faced surface of said drawer, said plurality of rollers being oppositely disposed to and aligned with said channel unit to movably support said drawer; and said channel unit including at least one rolling track being oppositely disposed to said first rolling unit within said internal cavity for movable support of said drawer;

whereby said drawer being movably supported by said plurality of rollers being moved through said at least one rolling track for said drawer being positionable in said concealed position or in said exposed position.

13. The improved safe of claim 12, wherein said channel unit comprises a plurality of pairs of roller tracks including at least two pair of roller tracks within said lower floor of said interior walls, each pair of roller tracks being positioned parallel to and aligned with said rolling unit of each drawer when each of said drawers are positioned in said concealed position, said at least two pair of roller tracks being indented in said lower floor of said internal cavity a sufficient depth to accept said rolling means of said drawer.

14. The improved safe of claim 13, wherein each of said rolling unit comprises at least one pair of rollers attached in parallel to each of said underside surface of each drawer, whereby each pair of rollers being insertable into said at least two pair of roller tracks being indented in said lower floor of said internal cavity to receive said plurality of rollers on said underside of said drawer, said at least two pair of parallel rollers project downward from said underside surface of each drawer for alignment with each respective parallel track indents when each drawer is positioned in said concealed position within said internal cavity.

15. The improved safe of claim 11, wherein said rolling means comprises:

said first rolling unit including a plurality of rollers aligned and attachable on said lower floor of said plurality of interior walls, said plurality of rollers being oppositely disposed to and aligned with said channel unit to movably support said drawer; and said channel unit including at least one rolling track being oppositely disposed from said first rolling unit, said channel unit being positioned on said outwardly faced surface of said drawer for movable support of said drawer;

whereby said drawer being movably supported by said plurality of rollers being moved through said at least one rolling track for said drawer being positionable in said concealed position or in said exposed position.

* * * * *